United States Patent [19]

Jagannathan et al.

[11] Patent Number: 4,818,286

[45] Date of Patent: Apr. 4, 1989

[54] ELECTROLESS COPPER PLATING BATH

[75] Inventors: Rangarajan Jagannathan; Mahadevaiyer Krishnan, both of Hopewell Junction; Gregory P. Wandy, Peekskill, all of N.Y.

[73] Assignee: International Business Machines Corporation, Armonk, N.Y.

[21] Appl. No.: 165,663

[22] Filed: Mar. 8, 1988

[51] Int. Cl.[4] ..... C23C 18/38; B05D 3/10

[52] U.S. Cl. ..... 106/1.23; 427/304; 427/437; 427/443.1

[58] Field of Search ..... 106/1.23, 1.26; 427/304, 437, 443.1; 204/38.4

[56] References Cited

U.S. PATENT DOCUMENTS

| | | | |
|---|---|---|---|
| 3,431,120 | 3/1969 | Weisenberger | 106/1.23 |
| 3,870,526 | 3/1975 | Pearlstein et al. | 106/1.23 |
| 3,928,670 | 12/1975 | Brummett et al. | 106/1.26 |
| 4,002,786 | 1/1977 | Hirohata et al. | 106/1.26 |
| 4,099,974 | 7/1978 | Morishita et al. | 106/1.23 |
| 4,303,443 | 12/1981 | Miyazawa et al. | 106/1.26 |
| 4,548,644 | 10/1985 | Nakaso et al. | 106/1.23 |
| 4,577,762 | 12/1985 | Nakaso et al. | 106/1.23 |
| 4,640,718 | 2/1987 | Alnot et al. | 106/1.11 |
| 4,643,793 | 2/1987 | Nakaso et al. | 106/1.23 |
| 4,650,691 | 3/1987 | Kinoshita et al. | 106/1.23 |

*Primary Examiner*—Paul Lieberman
*Assistant Examiner*—Helene Kirschner
*Attorney, Agent, or Firm*—Philip J. Feig

[57] ABSTRACT

An electroless copper plating bath contains copper sulfate, EDTA, DMAB and triethanolamine and is adjusted to a pH in the range between approximately 8 and 9. The addition of cyanide ions alone or preferably with a sulfur compound such as thiodipropionic acid or a nitrogen compound such as 1,10 phenanthroline provided bright copper deposits. The use of an electroless plating bath operating at a low pH permits electroless plating of alkali sensitive substrates.

26 Claims, 7 Drawing Sheets

ELECTROLESS COPPER PLATING BATH

This invention relates to electroless copper plating baths and more specifically relates to electroless copper plating baths operating at a pH between 8 and 9 and containing copper EDTA-Triethanolamine complex solution with DMAB as the reducing agent.

BACKGROUND OF THE INVENTION

Electroless copper plating is widely practiced in the electronics industry, particularly for plating through holes of printed circuit boards by the superior additive process. The current practice of electroless copper plating involves the use of formaldehyde as a reducing agent. Formaldehyde generally requires operation of the plating bath at a highly alkaline pH, greater than 11. The present plating bath operates at a pH less than 9, permitting electroless copper deposition on and in the presence of alkali sensitive substrates, such as polyimide and positive photoresist.

Prior plating baths utilizing Dimethylamine Borane (DMAB) as a reducing agent are known and described, for instance, in the article entitled "Electroless Copper Plating Using Dimethylamine Borane" by F. Pearlstein and R. F. Weightman, *Plating*, May, 1973, pages 474–476.

The same article refers to a plating bath containing both DMAB and Ethylenediamine Tetra-acetic Acid (EDTA) as a disodium salt with ammonium hydroxide for stabilizing the bath. The pH at room temperature was 10.7.

An electroless copper plating bath consisting of EDTA and triethanolamine with formaldehyde as a reducing agent, operating at a high pH level, is described in the book "Modern Electroplating" edited by F. A. Lowenheim, John Wiley & Sons, 1974, pages 734 to 739.

Additional prior art is found in U.S. Pat. No. 3,870,526 which refers to an electroless bath consisting of EDTA disodium salt and DMAB with ammonium hydroxide operating at a pH of approximately 10.7.

U.S. Pat. Nos. 4,273,804, 4,338,355, 4,339,476 refer to colloids and metallic dispersions which are seeds for further electroless plating.

U.S. Pat. No. 4,321,285 describes colloid based seeding and cobalt plating at pH in the range between 6 and 7 and copper plating with conventional formaldehyde based baths.

U.S. Pat. No. 4,318,940 describes stabilized colloidal dispersions for providing an economical process for preparing dielectric substrates for electroless plating.

Additional prior art is described in IBM Technical Disclosure Bulletin, Vol. 15, No. 1, June 1972 entitled "Autocatalytic Electroless Lead" concerning depositing of lead on copper; IBM Technical Disclosure Bulletin, Vol. 9, No. 10, March 1967 entitled "Chemical Nickel-Iron-Copper-Boron Films" concerning plating of alloys using tartate and ammonia complexes at high pH; and IBM Technical Disclosure Bulletin, Vol. 27, No. 1A, June 1984 entitled "Fast Plating Bath" concerning electroless copper plating using formaldehyde as the major reducing agent.

SUMMARY OF THE INVENTION

Electroless copper plating baths depend upon a reducing agent and a complexing agent for copper ions in solution. The most widely used reducing agents are Formaldehyde, Hypophosphite and amine-boranes. Formaldehyde is an effective reducing agent only at a pH above 11 and is ineffective for electroless plating at lower pH. Hypophosphite ion is used extensively for electroless Ni-P and Co-P plating over a wide range of pH. However, hypophosphite is a poor reducing agent for electroless copper and is usually limited to the deposition of up to one micron of copper. The remaining reagent, amine boranes, and particularly dimethyl amine borane (DMAB) is the preferred reducing agent.

The preferred plating bath contains copper sulfate, disodium salt of EDTA, DMAB and triethanolamine and is adjusted to have a pH in the range between approximately 8 and 9 while providing a stable bath. The addition of cyanide ions alone or preferably with a sulfur compound such as thiodipropionic acid or a nitrogen compound such as 1,10 phenanthroline provides bright copper deposits. The resulting bath obviates the use of formaldehyde or ammonium hydroxide and the resulting low pH of the bath permits electroless plating of alkali sensitive substrates.

A principal object of the present invention is, therefore, the provision of an electroless copper plating bath having a pH less than 9.

Another object of the invention is the provision of an electroless copper plating bath consisting of copper EDTA-Triethanolamine complex solution with DMAB as the reducing agent.

Further and still other objects of the invention will become more clearly apparent when the following description is read in conjunction with the accompanying drawings.

DETAILED DESCRIPTION

Figure 1:
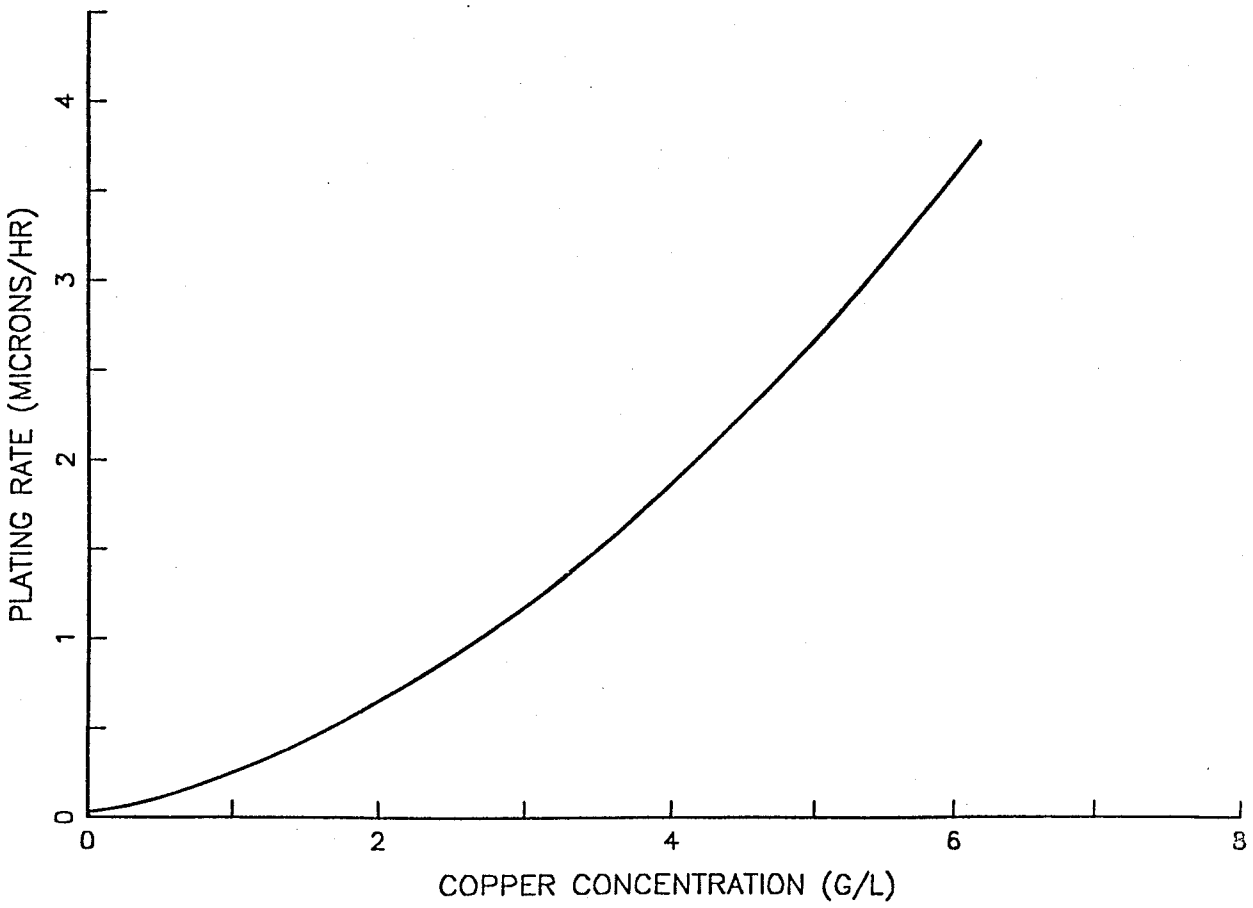
FIGS. 1, 2 and 3 are graphic representations of the effect of copper concentration on the plating rate for different plating bath solutions.

An electroless metal deposition process is essentially an electron transfer process mediated by a catalytic surface. The hetrogeneous catalytic process involves the acceptance of electrons from a reducing agent by the catalytic metal nuclei. The electron can be used to reduce the metal ions in solution, resulting in metal deposition on the surface. The electron can also be used in the process of hydrogen evolution from water, which does not aid in the metal deposition process.

The constitution of an electroless plating bath is optimized to maximize the heterogeneous electron transfer process involving metal deposition on the catalyzed portion of a substrate. Direct homogeneous reaction between the reducing agent and the metal ion is to be avoided to ensure the successful continuous operation of the electroless bath. Compliance with the above criteria enables patterned metal deposition which firmly adheres to catalyzed portions of a substrate and the building of fine line circuitry needed in modern high level computer packages. In the present example of an electroless copper plating bath, it is predominantly copper deposits which firmly adhere to various substrates.

Successful operation of an electroless copper bath depends upon the reducing agent and the complexing agent for copper ions in solution. In the present invention, the preferred reducing agent is Dimethyl Amine Borane (DMAB), although other amine boranes where the amine component is for example morpholine, T-butyl, isopropyl or the like are usable in practicing the invention.

A solution of a disodium salt of EDTA (0.05 to 0.10 mole per liter) and triethanolamine (0.3 to 0.7 mole per liter) was added to DMAB and the pH of the mixture was adjusted to between 8 and 9. The sodium salt of EDTA can be replaced with other alkali metals EDTA or free acid provided the pH is adjusted in the range between 8 and 9. Plating experiments were conducted at different temperatures, copper concentrations, DMAB concentrations and different brightener. Surfactants such as sodium lauryl sulfate, FC95 which is a commercial surfactant manufactured by the 3M Company, polyalkylene glycols, and GAFAC which is a commercial surfactant manufactured by GAF Corporation, are advantageous for the removal of hydrogen bubbles evolved during deposition.

The presence of EDTA and triethanolamine is essential for successful operation of the bath. A solution of cupric ions and EDTA adjusted to a pH of 9 with sodium hydroxide is unstable in the presence of DMAB and results in homogeneous deposition of copper. Cupric ion complexed with triethanolamine alone is also unstable when DMAB is added and results in immediate vigorous reaction depositing copper homogeneously. In addition to acting as a buffering agent, the presence of triethanolamine results in the formation of a mixed ligand complex of cupric ion-EDTA-Triethanolamine, leading to a stable electroless system. It is desirable to include other alkanolamines similar to triethanolamine for providing the buffering and complexing characteristics for achieving the successful operation of the bath. The preferred alkanolamine include the alkyl groups in the alkanolamine such as methyl, ethyl, isopropyl, propyl, butyl and the like including mixtures.

Additional agents, in micromolar concentrations, were found to be beneficial for depositing electroless copper with desirable qualities for electronic applications. The addition of cyanide ions alone or preferably with a sulfur compound such as thiodipropionic acid or a nitrogen compound such as 1,10 phenanthroline provides bright copper deposits.

In the evaluation of the quality of the copper deposited, the following criteria is used: (1) brightness or reflectivity, (2) hardness and (3) resistivity. When concerned with depositing thin copper films, brightness is used as an initial test and resistivity of 5 to 10 micron films is used as a test for the quality of the electroless copper.

In a typical plating experiment, a substrate of 100 angstroms of palladium on Cr/Si or 500 angstroms of copper on Cr/Si or bulk copper coupons degreased using trichloroethylene and treated with 3% nitric acid was placed in the bath. After one to five hours, the substrate is removed from the bath. The substrates are weighed before being placed in the bath and are weighed again after removal from the bath. The weight difference after plating is used to determine the plating rate.

Similar experiments were conducted using epoxy substrates. The substrates were activated by dipping the substrate in colloidal Pd/Sn solutions and rinsing with 1M sodium hydroxide followed by rinsing with water. The plating rate was also determined from weight gain data.

Figure 2:
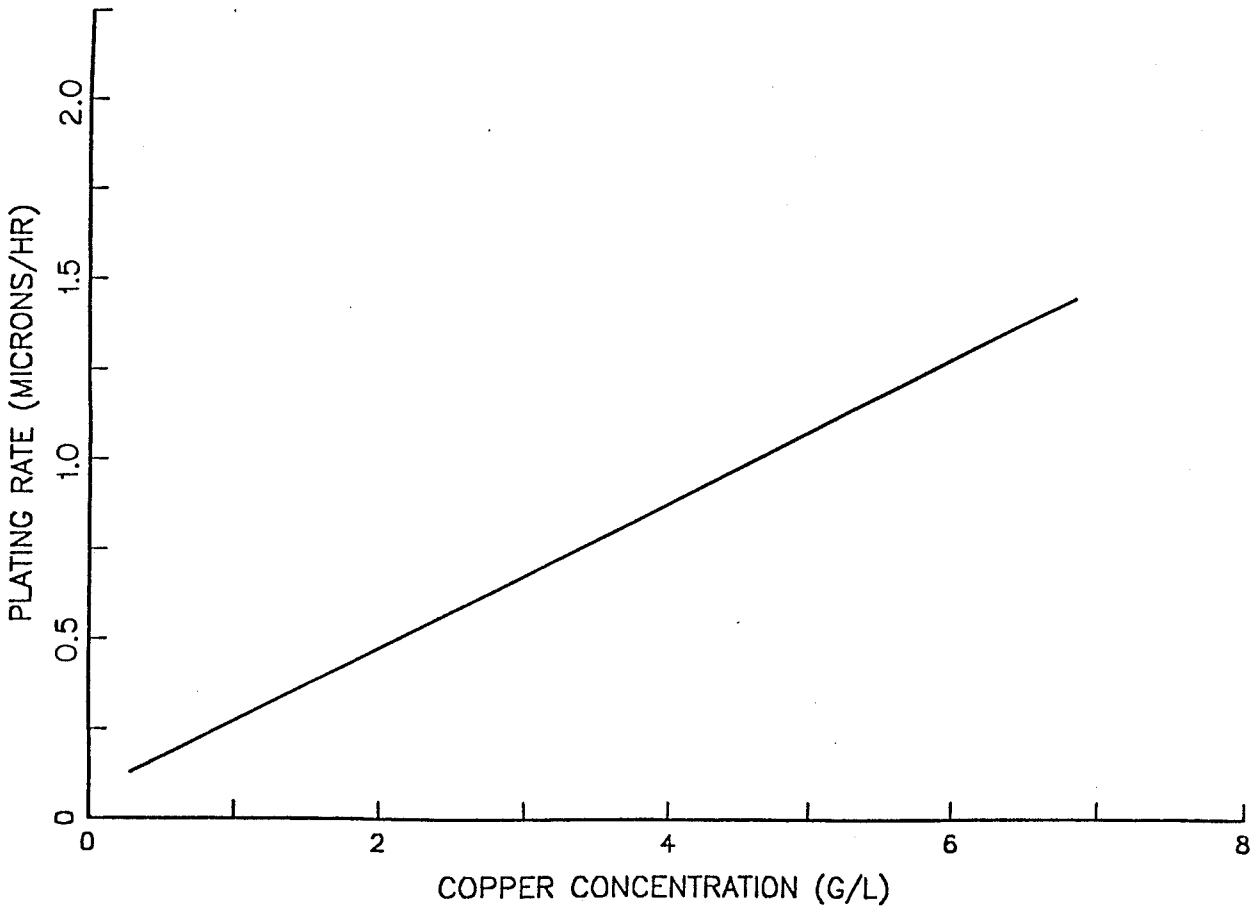
Figure 3:
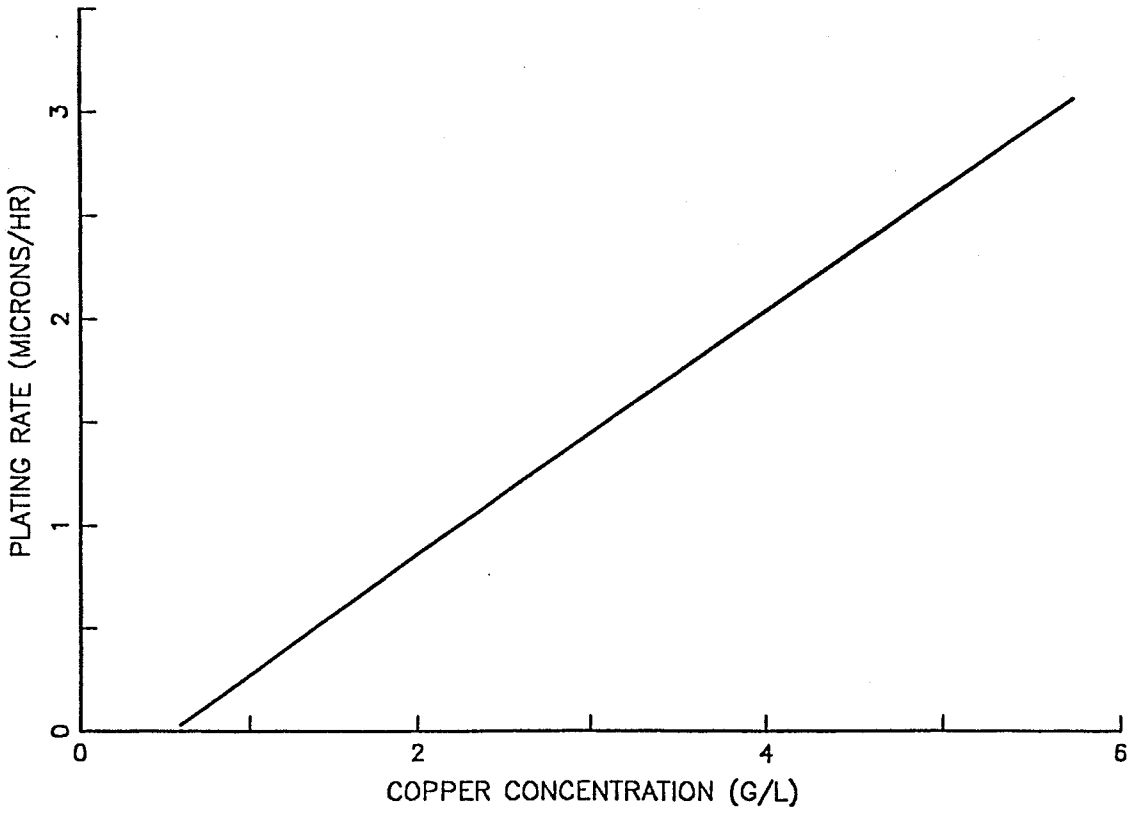

Plating rate data are shown in the accompanying figures. FIG. 1 illustrates the effect of varying the cupric ion concentration at constant DMAB concentration of 4 grams per liter with 20 grams per liter of EDTA, 50 milliliters per liter of triethanolamine, 96 micrograms per liter of sodium cyanide and 22 micrograms per liter of 1,10 phenanthroline. FIG. 2 illustrates the effects of varying the cupric ion concentration at constant DMAB concentration of 4 grams per liter with 20 grams per liter of EDTA, 50 milliliters per liter of triethanolamine, 128 micrograms per liter of sodium cyanide and 22 micrograms per liter of 1,10 phenanthroline. FIG. 3 illustrates the effects of varying the cupric ion concentration at constant DMAB of 4 grams per liter with 20 grams per liter of EDTA, 50 milliliters per liter of triethanolamine, 128 micrograms per liter of sodium cyanide, 22 micrograms per liter of pphenanthroline with the addition of a surfactant, 10 milligrams per liter of sodium lauryl sulfate.

In FIGS. 1, 2 and 3, an increase in plating rate with copper concentration is observed. The plating was performed on bulk copper coupons in a bath containing 20 grams per liter of disodium EDTA and 50 milliliters per liter of triethanolamine. The pH of the solution was 8.7. Copper concentrations above 5 grams per liter induce bath instability. However, by increasing EDTA concentration to 40 grams per liter and triethanolamine to 100 ml per liter, higher copper concentrations of up to 8 grams per liter are usable with the bath remaining stable.

Figure 4:
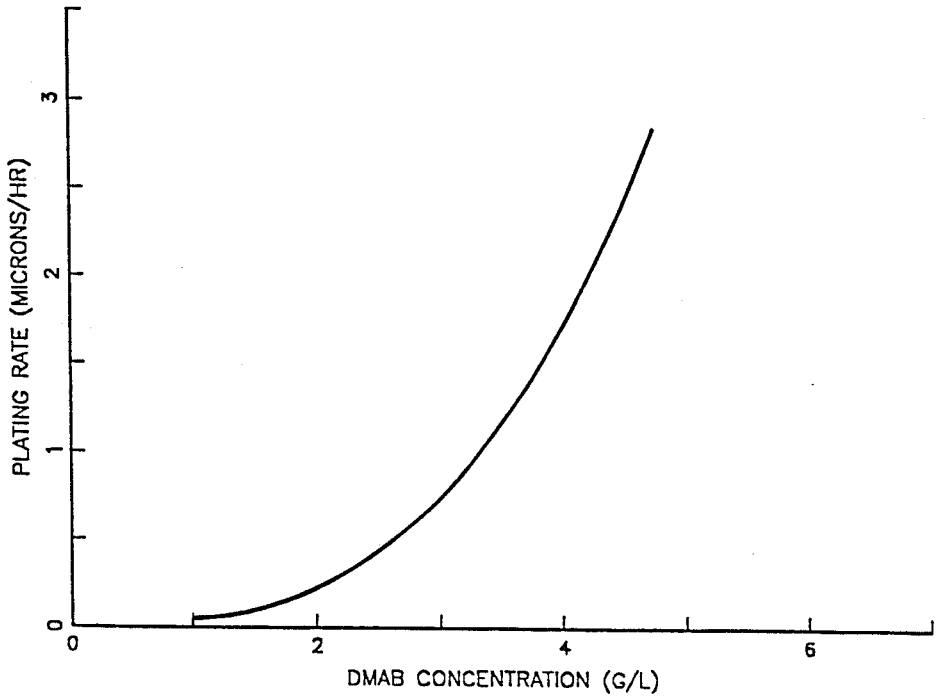
FIGS. 4, 5 and 6 are graphic representations of the effect of DMAB concentration on the plating rate for different plating bath solutions.
Figure 5:
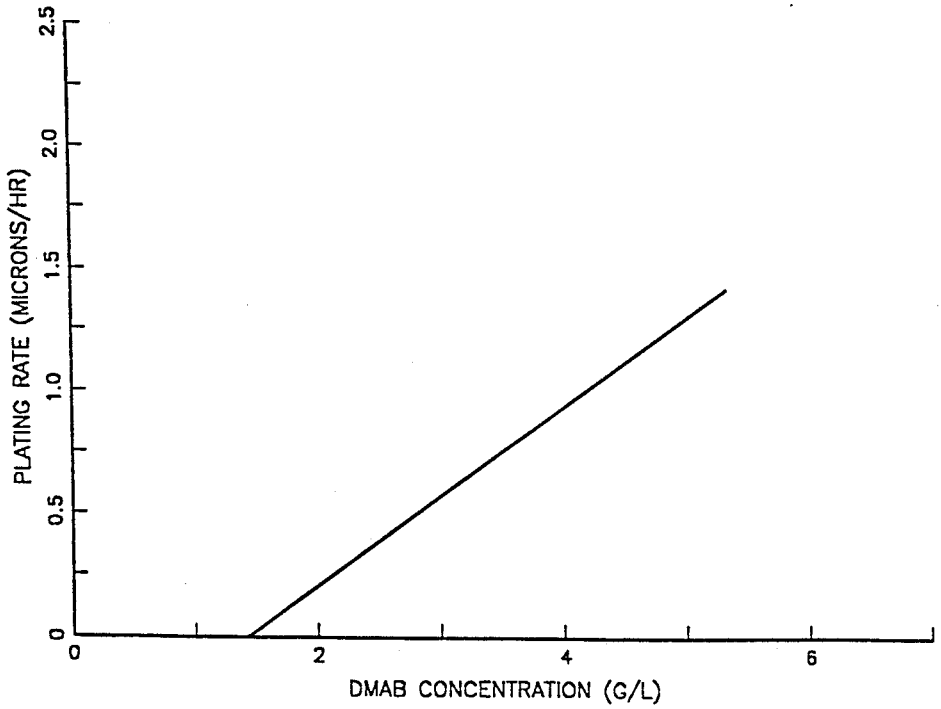
Figure 6:
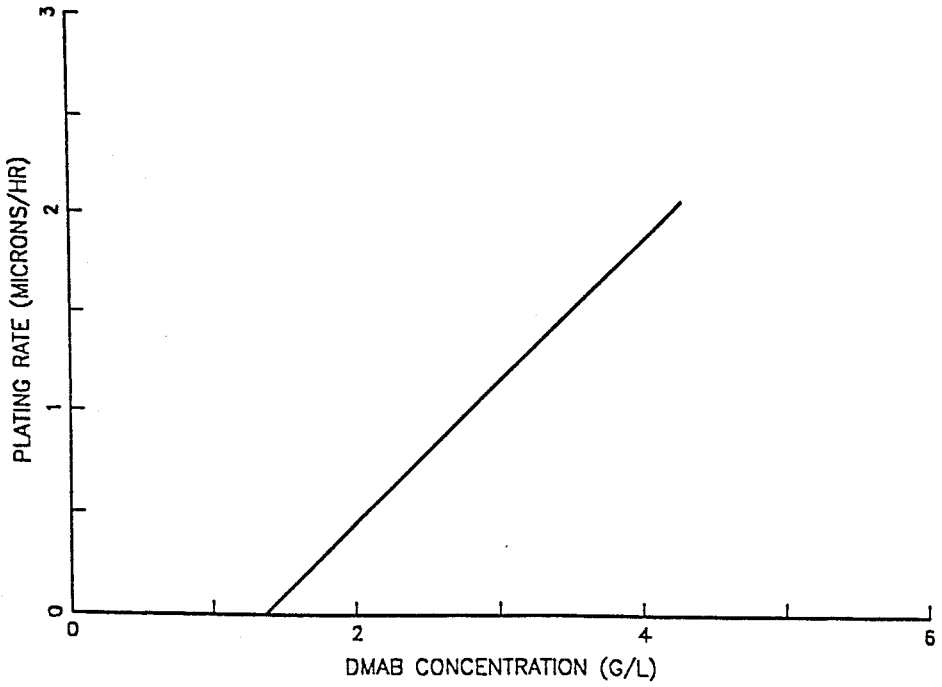

FIGS. 4, 5 and 6 illustrate the effect of DMAB concentration on the plating rate. FIG. 4 illustrates the effects of varying the concentration of DMAB within a solution containing 4 grams per liter of copper sulfate, 20 grams per liter of EDTA, 50 milliliters per liter of triethanolamine, 96 micrograms per liter of sodium cyanide and 22 micrograms per liter of 1,10 phenanthroline. FIG. 5 illustrates the effects of varying the concentration of DMAB within a solution containing 4 grams per liter of copper sulfate, 20 grams per liter of EDTA, 50 milliliters per liter of triethanolamine, 128 micrograms per liter of sodium cyanide and 22 micrograms per liter of 1,10 phenanthroline. FIG. 6 illustrates the effects of varying the concentration of DMAB within a solution containing 4 grams per liter of copper sulfate, 20 grams per liter of EDTA, 50 milliliters per liter of triethanolamine, 128 micrograms per liter of sodium cyanide, 22 micrograms per liter of 1,10 phenanthroline with the addition of a surfactant, 10 milligrams per liter of sodium lauryl sulfate.

FIGS. 4, 5 and 6 demonstrate that increasing the DMAB concentration increases the plating rate. DMAB concentrations above 5 grams per liter result in bath instability. Best results are obtained at concentrations of 4 grams per liter.

A study of the effect of pH on plating rate shows an increase in plating rate with increase in pH. The plating rate is negligible when the pH is below 8 and the bath tends to decompose when the pH is about 9.5.

Figure 7:
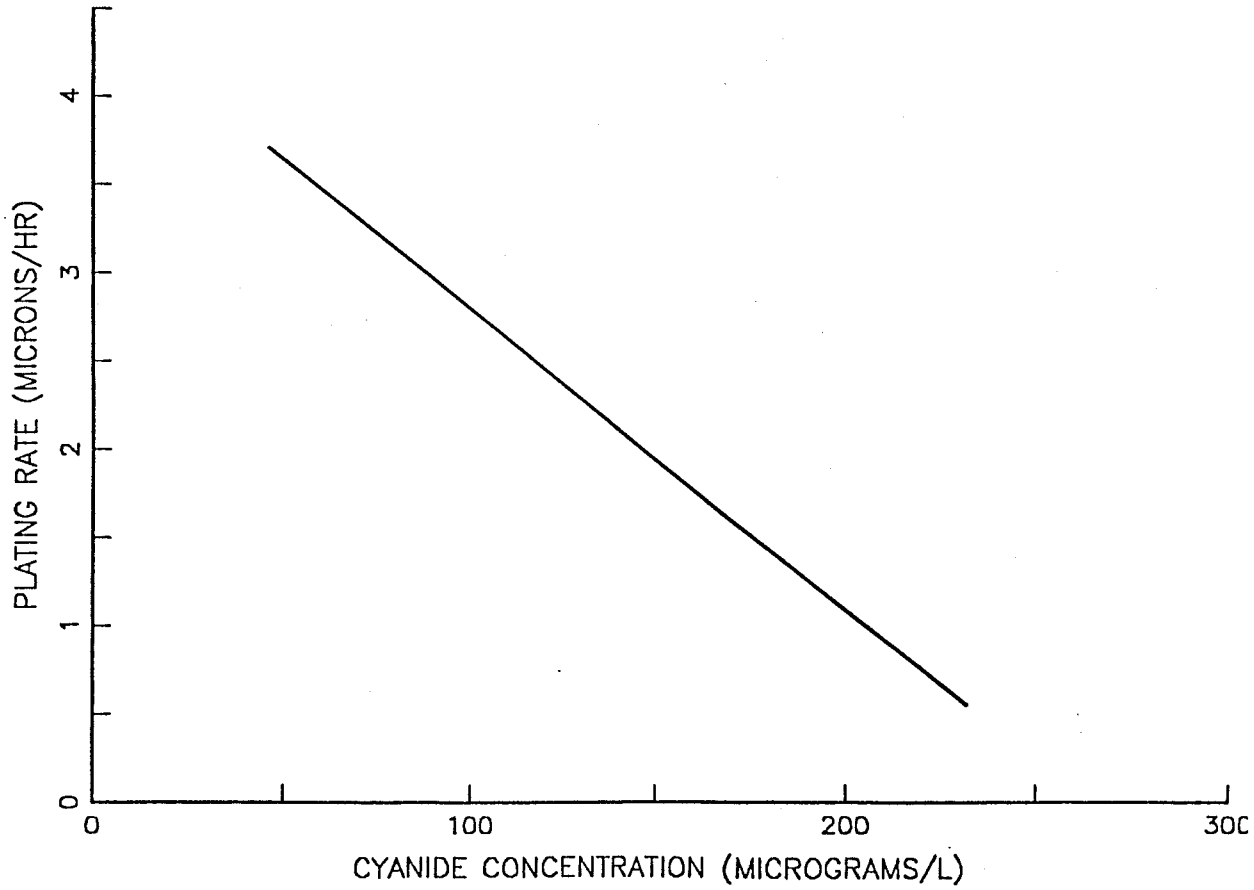
FIG. 7 is a graphic representation of the effect of cyanide concentration on the plating rate.

The brightness of the plated copper is affected by the presence of additives such as cyanide. It has also been observed that the addition of cyanide has a profound effect on the plating rate. There is a decrease of plating rate with increasing cyanide concentration as shown in FIG. 7. FIG. 7 illustrates the effect on the plating rate of varying cyanide concentration in a solution containing 4 grams per liter of DMAB, 20 grams per liter of EDTA, 50 milliliters per liter of triethanolamine, 4 grams per liter of copper sulfate, 22 micrograms per liter of 1,10 phenanthroline and 10 milligrams per liter of sodium lauryl sulfate.

In order to achieve optimum copper brightness and optimum resistivity, the presence of an additional reagent, such as 1,10 phenanthroline, is beneficial. Varying the concentration of the 1,10 phenanthroline had no effect on the plating rate.

The effect of temperature on the plating rate was studied for temperatures between 45 and 70 degrees centigrade. The plating rate decreases with increasing temperature, which result is unexpected and contrary to the generally known temperature effect of electroless plating baths.

As a result of the experiments conducted and the results achieved as described above, the preferred plating bath composition consists of the following:

4 grams per liter of copper sulfate
20 grams per liter of EDTA (preferably a disodium salt)
50 ml per liter of triethanolamine (preferably at a pH of 8.7)
4 grams per liter of DMAB
1.6 to 2.0 micromoles per liter of cyanide (preferably sodium cyanide)
22 micrograms per liter of 1,10 phenanthroline The resulting bath is operated at 60° C. The plating rate under the specified conditions is in the range between 2 to 3 microns per hour. The plating rate is between 2 and 3 microns per hour on epoxy substrates activated with a Pd/Sn colloid.

The use of the described electroless plating bath in multilayer thin film circuitry application requires high quality copper. The following table depicts four probe resistivity data of thin copper films plated using the bath described in the present invention. It is observed that copper quality comparable to that achieved with conventional copper-formaldehyde bath is obtained.

ELECTROLESS COPPER RESISTIVITY DATA

| THICKNESS (Microns) | RESISTIVITY (Microohm cm) | CONDITIONS |
|---|---|---|
| 5.20 | 2.23 | Paladium substrate, formaldehyde bath, no cyanide. |
| 6.77 | 2.11 | Paladium substrate, formaldehyde bath, cyanide. |
| 7.50 | 2.30 | Copper substrate, DMAB bath, cyanide and phenanthroline additives. |
| 6.50 | 2.40 | Copper substrate, DMAB bath, cyanide and phenanthroline additives. |
| 8.48 | 2.75 | Epoxy (Paladium colloid seed), formaldehyde bath. |
| 7.02 | 3.00 | Epoxy (Paladium colloid seed), DMAB bath, cyanide and phenanthroline additives. |
| 3.40 | 2.40 | Paladium substrate, DMAB bath, cyanide and phenanthroline additives. |

A Si/Cr/Cu substate with 5000 Angstroms of copper was patterned with a positive photoresist and disposed in the described electroless plating bath with acceptable plating occurring.

While there has been described a preferred electroless copper plating bath, variations and modifications are possible without deviating from the scope of the invention, which shall be limited solely by the claims appended hereto.

Having thus described our invention, what we claim as new and desire to secure by Letters Patent is:

1. An electroless copper plating bath for providing a predominately copper deposit which is firmly adherent to various substrates, said bath being devoid of formaldehyde comprising:

2 to 8 grams per liter of copper sulfate 20 to 40 grams per liter of EDTA 3 to 5 grams per liter of amine borane, and 50 to 100 milliliters per liter of alkanolamine, wherein said EDTA is selected from the group consisting of an alkali metal EDTA, said amine borane is selected from the group consisting of DMAB, morpholineamineborane, t-butylamineborane and isopropylamineborane and alkanolimine is selected from the group consisting of triethanolamine, alkyl groups in the alkanolamine, including mixtures.

2. An electroless copper plating bath as set forth in claim 1, further comprising 1.6 to 2.0 micromoles per liter of cyanide.

3. An electroless copper plating bath as set forth in claim 2, said cyanide being sodium cyanide.

4. An electroless copper plating bath as set forth in claim 2, further comprising 22 micrograms per liter of 1,10 phenanthroline.

5. An electroless copper plating bath as set forth in claim 4, wherein the pH of said bath is in the range between 8.0 and 9.5.

6. An electroless copper plating bath as set forth in claim 4, wherein the pH of said bath is in the range between 8.0 and 9.0.

7. An electroless copper plating bath as set forth in claim 4, wherein said bath is operated at a temperature of approximately 60° centigrade.

8. An electroless copper plating bath as set forth in claim 4, wherein said EDTA is a disodium salt.

9. An electroless copper plating bath as set forth in claim 4, wherein said alkanolamine is triethanolamine.

10. An electroless copper plating bath as set forth in claim 9, wherein said triethanolamine has a pH of 8.7.

11. An electroless copper plating bath as set forth in claim 1, wherein the pH of said bath is in the range between 8.0 and 9.5.

12. An electroless copper plating bath as set forth in claim 1, wherein the pH of said bath is in the range between 8.0 and 9.0.

13. An electroless copper plating bath as set forth in claim 1, wherein said bath is operated at a temperature of approximately 60° centigrade.

14. An electroless copper plating bath as set forth in claim 1, wherein said EDTA is a disodium salt.

15. An electroless copper plating bath as set forth in claim 1, wherein said alkanolamine is triethanolamine.

16. An electroless copper plating bath as set forth in claim 15, wherein said triethanolamine has a pH of 8.7.

17. An electroless copper plating bath as set forth in claim 1, wherein said substrate is an alkali sensitive substrate.

18. An electroless copper plating bath as set forth in claim 17, wherein said alkali sensitive substrate is polyimide.

19. An electroless copper plating bath as set forth in claim 17, wherein said alkali sensitive substrate includes positive photoresist.

20. An electroless copper plating bath as set forth in claim 1, wherein said substrate is an epoxy substrate.

21. An electroless copper plating bath as set forth in claim 20, wherein said epoxy substrate is activated with Pd/Sn colloid.

22. An electroless copper plating bath as set forth in claim 2, further comprising thiodipropionic acid.

23. An electroless copper plating bath as set forth in claim 1, wherein said copper sulfate is present in an amount of 4 grams per liter, said EDTA is present in an amount of 20 grams per liter, said DMAB is present in an amount of 4 grams per liter and said triethanolamine is present in an amount of 50 milliliters per liter.

24. An electroless copper plating bath as set forth in claim 23, further comprising 128 micrograms per liter of sodium cyanide, 22 micrograms per liter of 1,10 phenanthroline and 10 milligrams per liter of sodium lauryl sulfate.

25. An electroless copper plating bath as set forth in claim 1, wherein said EDTA is a disodium salt, said amine borane is DMAB, and said alkanolamine is triethanolamine.

26. An electroless copper plating bath as set forth in claim 25, further comprising 1.6 to 2.0 micromoles per liter of sodium cyanide, 22 micrograms per liter of 1,10 phenanthroline and 10 milligrams per liter of sodium lauryl sulfate.

* * * * *